US011004405B2

(12) United States Patent
Pyun et al.

(10) Patent No.: US 11,004,405 B2
(45) Date of Patent: May 11, 2021

(54) LIGHT SOURCE APPARATUS, DISPLAY APPARATUS INCLUDING THE SAME AND METHOD OF COMPENSATING LUMINANCE DIFFERENCE OF THE SAME

(71) Applicant: Samsung Display Co., Ltd., Yongin-Si (KR)

(72) Inventors: Kihyun Pyun, Gwangmyeong-si (KR); Moonshik Kang, Hwaseong-si (KR); Dae-Sik Lee, Hwaseong-si (KR); Jun Pyo Lee, Asan-si (KR); Min-Soo Choi, Hwaseong-si (KR); Songyi Han, Asan-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/725,202

(22) Filed: Dec. 23, 2019

(65) Prior Publication Data

US 2020/0211482 A1 Jul. 2, 2020

(30) Foreign Application Priority Data

Dec. 28, 2018 (KR) ..... 10-2018-0171869

(51) Int. Cl.
*G09G 3/34* (2006.01)
*H05B 45/14* (2020.01)

(52) U.S. Cl.
CPC ..... *G09G 3/3406* (2013.01); *H05B 45/14* (2020.01); *G09G 2330/023* (2013.01); *G09G 2360/145* (2013.01)

(58) Field of Classification Search
CPC ..... G09G 2300/023; G09G 2300/0819; G09G 2300/0842; G09G 2300/0861; G09G 2320/0233; G09G 2320/029; G09G 2320/0295; G09G 2320/045; G09G 2320/0693; G09G 2330/023; G09G 2360/145; G09G 3/3225; G09G 3/3406; G09G 3/3426; G09G 3/3648; H05B 45/14
See application file for complete search history.

(56) References Cited

U.S. PATENT DOCUMENTS

2006/0139264 A1 6/2006 Choi et al.
2007/0080908 A1* 4/2007 Nathan ..... H05B 47/10 345/77

(Continued)

FOREIGN PATENT DOCUMENTS

KR 1020120061542 6/2012
KR 101351414 B1 1/2014

OTHER PUBLICATIONS

Partial European Search Report—European Patent Application No. 19219902.4 dated Mar. 31, 2020, citing references listed within.

*Primary Examiner* — Hong Zhou
(74) *Attorney, Agent, or Firm* — Cantor Colburn LLP

(57) ABSTRACT

A light source apparatus includes a plurality of light source gate lines extending in a first direction, a plurality of light source data lines extending in a second direction crossing the first direction, a plurality of light source emission lines, a plurality of feedback lines and a plurality of light source blocks. At least one of the light source blocks is connected to the light source gate line, the light source data line, the light source emission line and the feedback line.

20 Claims, 12 Drawing Sheets

(56) References Cited

U.S. PATENT DOCUMENTS

| | | | | |
|---|---|---|---|---|
| 2009/0135119 | A1* | 5/2009 | Kang | G09G 3/3426 345/87 |
| 2009/0295309 | A1 | 12/2009 | Kang et al. | |
| 2011/0075072 | A1* | 3/2011 | Kim | G09G 3/3426 349/69 |
| 2016/0307503 | A1* | 10/2016 | Song | G09G 3/3291 |
| 2017/0032738 | A1* | 2/2017 | Lee | G09G 3/3233 |
| 2017/0039953 | A1* | 2/2017 | Lee | G09G 3/3233 |
| 2017/0069273 | A1* | 3/2017 | Park | G09G 3/3233 |
| 2017/0287395 | A1* | 10/2017 | Jang | G09G 3/3291 |
| 2017/0367160 | A1 | 12/2017 | Scenini et al. | |
| 2018/0074632 | A1 | 3/2018 | Fong | |

* cited by examiner

FIG. 13

| LUMINANCE PART 1024 GRAYSCALE | LUMINANCE DATA BIT | | | | | | | | | | COMPNESATION PART 16 GRAYSCALE | COMPNESATION DATA BIT | | | |
|---|---|---|---|---|---|---|---|---|---|---|---|---|---|---|---|
| | MSB [10] | [9] | [8] | [7] | [6] | [5] | [4] | [3] | [2] | LSB [1] | | MSB [4] | [3] | [2] | LSB [1] |
| MAX LUMINANCE (1023 GRAYSCALE) | 1 | 1 | 1 | 1 | 1 | 1 | 1 | 1 | 1 | 1 | MAX COMPNESATION (15 GRAYSCALE) | 1 | 1 | 1 | 1 |
| MIN LUMINANCE (0 GRAYSCALE) | 0 | 0 | 0 | 0 | 0 | 0 | 0 | 0 | 0 | 0 | MIN COMPNESATION (0 GRAYSCALE) | 0 | 0 | 0 | 0 |

LIGHT SOURCE APPARATUS, DISPLAY APPARATUS INCLUDING THE SAME AND METHOD OF COMPENSATING LUMINANCE DIFFERENCE OF THE SAME

This application claims priority to Korean Patent Application No. 10-2018-0171869, filed on Dec. 28, 2018 and all the benefits accruing therefrom under 35 U.S.C. § 119, the content of which in its entirety is herein incorporated by reference.

BACKGROUND

1. Field

Exemplary embodiments of the invention relate to a light source apparatus, a display apparatus including the light source apparatus and a method of compensating luminance difference of the display apparatus. More particularly, exemplary embodiments of the invention relate to a light source apparatus compensating luminance difference of light source blocks, a display apparatus including the light source apparatus and a method of compensating luminance difference of the display apparatus.

2. Description of the Related Art

In a local dimming method, a degree of turning-on of a light source is determined corresponding to a luminance of a block of input image data to reduce a power consumption of a display apparatus.

SUMMARY

To operate the local dimming method, each light source blocks may be independently controlled. When the number of the light source block controllers is same as the number of the light source blocks, a manufacturing cost of a light source apparatus may be increased and a complexity of the light source apparatus may be increased.

Exemplary embodiments of the invention provide a light source apparatus using an active matrix method to reduce a manufacturing cost and a complexity and effectively compensating luminance difference of light source blocks.

Exemplary embodiments of the invention also provide a display apparatus including the light source apparatus.

Exemplary embodiments of the invention also provide a method of compensating luminance difference of the light source apparatus.

In an exemplary embodiment of a light source apparatus according to the invention, the light source apparatus includes a plurality of light source gate lines extending in a first direction, a plurality of light source data lines extending in a second direction crossing the first direction, a plurality of light source emission lines, a plurality of feedback lines and a plurality of light source blocks. At least one of the plurality of light source blocks is connected to a light source gate line of the plurality of light source gate lines, a light source data line of the plurality of light source data lines, a light source emission line of the plurality of light source emission lines and a feedback line of the plurality of feedback lines.

In an exemplary embodiment, the feedback line may be commonly connected to light source blocks of the plurality of light source blocks disposed in a light source block column.

In an exemplary embodiment, a first end portion of the feedback line may be connected to the light source blocks disposed in the light source block column and a second end portion of the feedback line is connected to a feedback resistor. The feedback resistor may be connected between a power voltage applying terminal of a light source block of the light source blocks and the second end portion of the feedback line.

In an exemplary embodiment, a light source block of the plurality of light source blocks may include a light emitting element, a first switching element including a control electrode connected to the light source gate line, an input electrode connected to the light source data line and an output electrode connected to a control electrode of a second switching element, the second switching element including the control electrode connected to the output electrode of the first switching element, an input electrode connected to an output electrode of a third switching element and an output electrode connected to a ground and the third switching element including a control electrode connected to the light source emission line, an input electrode connected to the light emitting element and the output electrode connected to the input electrode of the second switching element.

In an exemplary embodiment, the feedback line may extend in a direction parallel to the light source data line.

In an exemplary embodiment of a display apparatus according to the invention, the display apparatus includes a display panel, a gate driver, a data driver, a light source apparatus and a light source driver. The display panel displays an image. The gate driver applies a gate signal to the display panel. The data driver applies a data voltage to the display panel. The light source apparatus provides light to the display panel. The light source driver drives the light source apparatus. The light source apparatus includes a plurality of light source gate lines extending in a first direction, a plurality of light source data lines extending in a second direction crossing the first direction, a plurality of light source emission lines, a plurality of feedback lines and a plurality of light source blocks. At least one of the plurality of light source blocks is connected to a light source gate line of the plurality of light source gate lines, a light source data line of the plurality of light source data lines, a light source emission line of the plurality of light source emission lines and a feedback line of the plurality of feedback lines.

In an exemplary embodiment, the feedback line may be commonly connected to light source blocks of the plurality of light source blocks disposed in a light source block column.

In an exemplary embodiment, a first end portion of the feedback line may be connected to the light source blocks disposed in the light source block column and a second end portion of the feedback line is connected to a feedback resistor. The feedback resistor may be connected between a power voltage applying terminal of the light source block and the second end portion of the feedback line.

In an exemplary embodiment, a light source block of the plurality of light source blocks may include a light emitting element, a first switching element including a control electrode connected to the light source gate line, an input electrode connected to the light source data line and an output electrode connected to a control electrode of a second switching element, the second switching element including the control electrode connected to the output electrode of the first switching element, an input electrode connected to an output electrode of a third switching element and an output electrode connected to a ground and the third switching element including a control electrode connected to the light source emission line, an input electrode connected to the light emitting element and the output electrode connected to the input electrode of the second switching element.

In an exemplary embodiment, the light source block may include a light emitting element. The light source driver may include a first switching element including a control electrode connected to the light source gate line, an input electrode connected to the light source data line and an output electrode connected to a control electrode of a second switching element, the second switching element including the control electrode connected to the output electrode of the first switching element, an input electrode connected to an output electrode of a third switching element and an output electrode connected to a ground and the third switching element including a control electrode connected to the light source emission line, an input electrode connected to the light emitting element and the output electrode connected to the input electrode of the second switching element.

In an exemplary embodiment, the feedback line may extend in a direction parallel to the light source data line.

In an exemplary embodiment, the display apparatus may further include a plurality of light source registers which stores sensed currents of the light source blocks of the plurality of light source blocks which are fed back through the feedback line and a light source compensator including a compensation controller which receives the sensed currents of the light source blocks which are stored in the plurality of light source registers and generates a compensated light source data signal for compensating luminance difference between the light source blocks.

In an exemplary embodiment, the light source compensator may include a first light source register which stores a first sensed current in response to a first light source gate signal through a first feedback line, a second light source register which stores a second sensed current in response to the first light source gate signal through a second feedback line, a third light source register which stores a third sensed current in response to a second light source gate signal through the first feedback line and a fourth light source register which stores a fourth sensed current in response to the second light source gate signal through the second feedback line.

In an exemplary embodiment, the light source compensator may further include a first error amplifier which compares a signal transmitted through the first feedback line to a reference voltage and a first analog to digital converter ("ADC") connected to the first error amplifier. The first ADC may be connected to the first light source register and the third light source register.

In an exemplary embodiment, the light source compensator may further include a second error amplifier which compares a signal transmitted through the second feedback line to the reference voltage and a second ADC connected to the second error amplifier. The second ADC may be connected to the second light source register and the fourth light source register.

In an exemplary embodiment, the display apparatus may further include a driving controller which controls driving timings of the gate driver, the data driver and the light source driver. The light source compensator may be disposed in the driving controller.

In an exemplary embodiment, the light source compensator may be disposed in the light source driver.

In an exemplary embodiment, the compensated light source data signal may include luminance data bits representing a target luminance according to a local dimming method and compensation data bit for compensating the luminance difference between the light source blocks.

In an exemplary embodiment of a method of compensating luminance difference of a light source apparatus, the method includes applying a plurality of light source gate signals to a plurality of light source gate lines, applying a plurality of light source data signals to a plurality of light source data lines, applying a light source emission signal to a plurality of light source emission lines, sensing currents flowing through a plurality of light source blocks through a plurality of feedback lines and generating a compensated light source data signal using the sensed currents through feedback lines of the plurality of feedback lines.

In an exemplary embodiment, the currents flowing through the plurality of light source blocks may be sensed in an initial period when a display apparatus is turned on.

According to the light source apparatus, the display apparatus and the method of compensating luminance difference of the light source apparatus, the light source apparatus may be driven using the active matrix method so that the manufacturing cost and the complexity of the light source apparatus may be reduced. The light source apparatus includes the light source blocks connected to the light source gate lines, the light source data lines, the light source emission lines and the feedback line and the currents of the light source blocks are fed back so that the luminance difference between the light source blocks may be compensated.

BRIEF DESCRIPTION OF THE DRAWINGS

The above and other features and advantages of the invention will become more apparent by describing in detailed exemplary embodiments thereof with reference to the accompanying drawings, in which:

FIG. 13 is a conceptual diagram illustrating a configuration of a compensated light source data signal generated by the compensation controller of FIG. 12;

DETAILED DESCRIPTION

Figure 1:
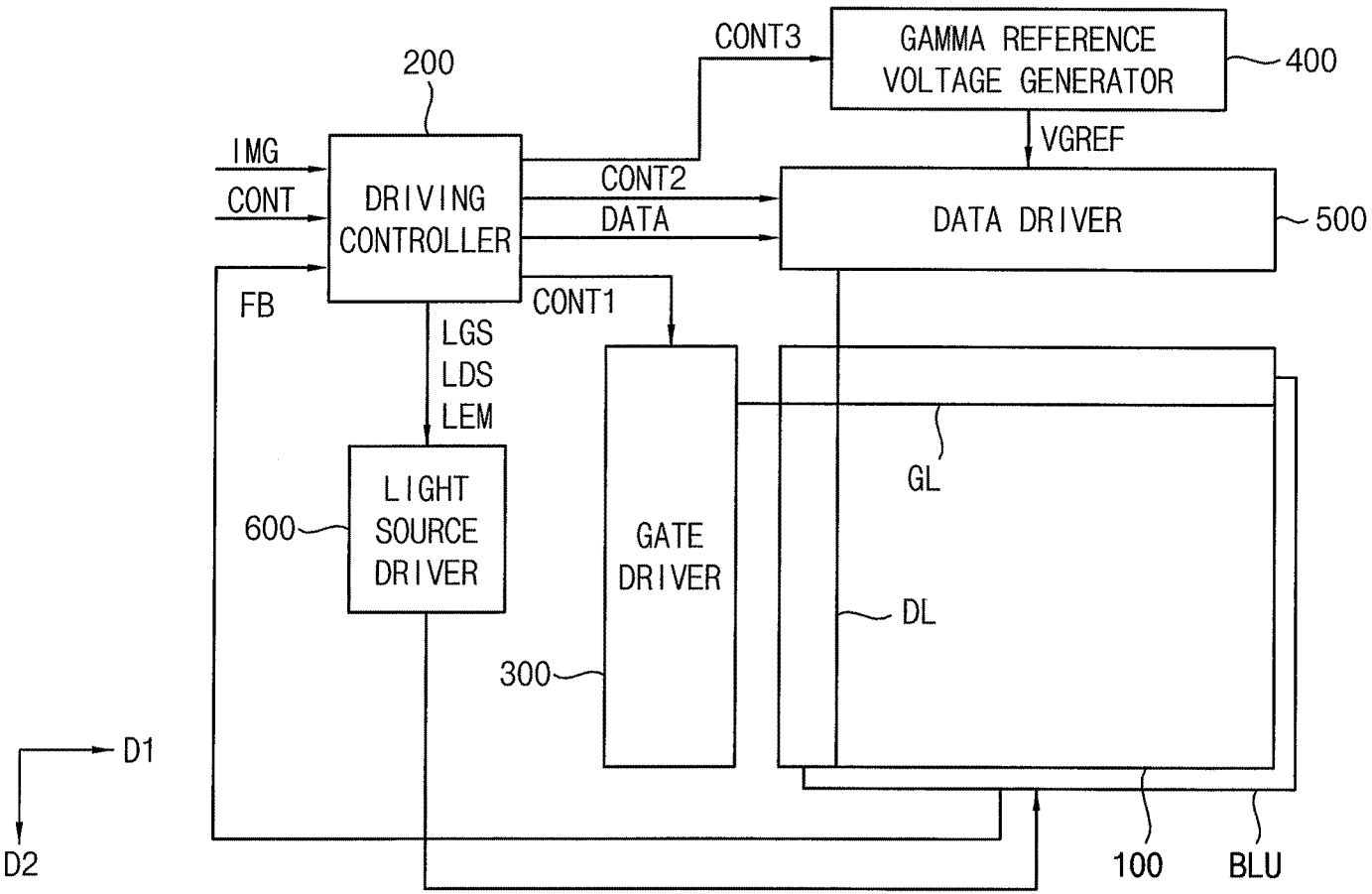
FIG. 1 is a block diagram illustrating an exemplary embodiment of a display apparatus according to the invention.

Hereinafter, the invention will be explained in detail with reference to the accompanying drawings.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a block diagram illustrating an exemplary embodiment of a display apparatus according to the invention.

Referring to FIG. 1, the display apparatus includes a display panel 100 and a display panel driver. The display panel driver includes a driving controller 200, a gate driver 300, a gamma reference voltage generator 400 and a data driver 500. The display apparatus may further include a light source apparatus BLU providing light to the display panel 100 and a light source driver 600 driving the light source apparatus BLU.

The display panel 100 includes a plurality of gate lines GL, a plurality of data lines DL and a plurality of pixels electrically connected to the gate lines GL and the data lines DL. The gate lines GL may extend in a first direction D1 and the data lines DL may extend in a second direction D2 crossing the first direction D1.

The display panel 100 may include a first base substrate on which the gate lines GL, the data lines DL, the pixels and switching elements are disposed, a second base substrate facing the first base substrate and including a common electrode and a liquid crystal layer disposed between the first base substrate and the second base substrate.

The driving controller 200 may receive the input image data IMG and an input control signal CONT from an external apparatus. In an exemplary embodiment, the input image data IMG may include red image data, green image data and blue image data, for example. In an exemplary embodiment, the input image data IMG may include white image data, for example. In an exemplary embodiment, the input image data IMG may include magenta image data, cyan image data and yellow image data, for example. However, the invention is not limited thereto, and in another exemplary embodiment, the input image data IMG may include various other color data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 may output a light source gate signal LGS, a light source data signal LDS and a light source emission signal LEM to the light source driver 600.

In addition, the driving controller 200 generates a dimming signal DIMM to control a dimming operation of the light source apparatus BLU based on the input image data IMG. The driving controller 200 outputs the dimming signal to the light source driver 600. The dimming signal may be a local dimming signal representing a degree of dimming of each light source blocks of the light source apparatus BLU. In an exemplary embodiment, the light source data signal LDS may include the dimming signal, for example.

The gate driver 300 generates gate signals driving the gate lines GL in response to the first control signal CONT1 received from the driving controller 200. The gate driver 300 may output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The light source driver 600 may receive the light source gate signal LGS, the light source data signal LDS and the light source emission signal LEM from the driving controller 200. The light source driver 600 may drive the light source apparatus BLU based on the light source gate signal LGS, the light source data signal LDS and the light source emission signal LEM.

Figure 2:
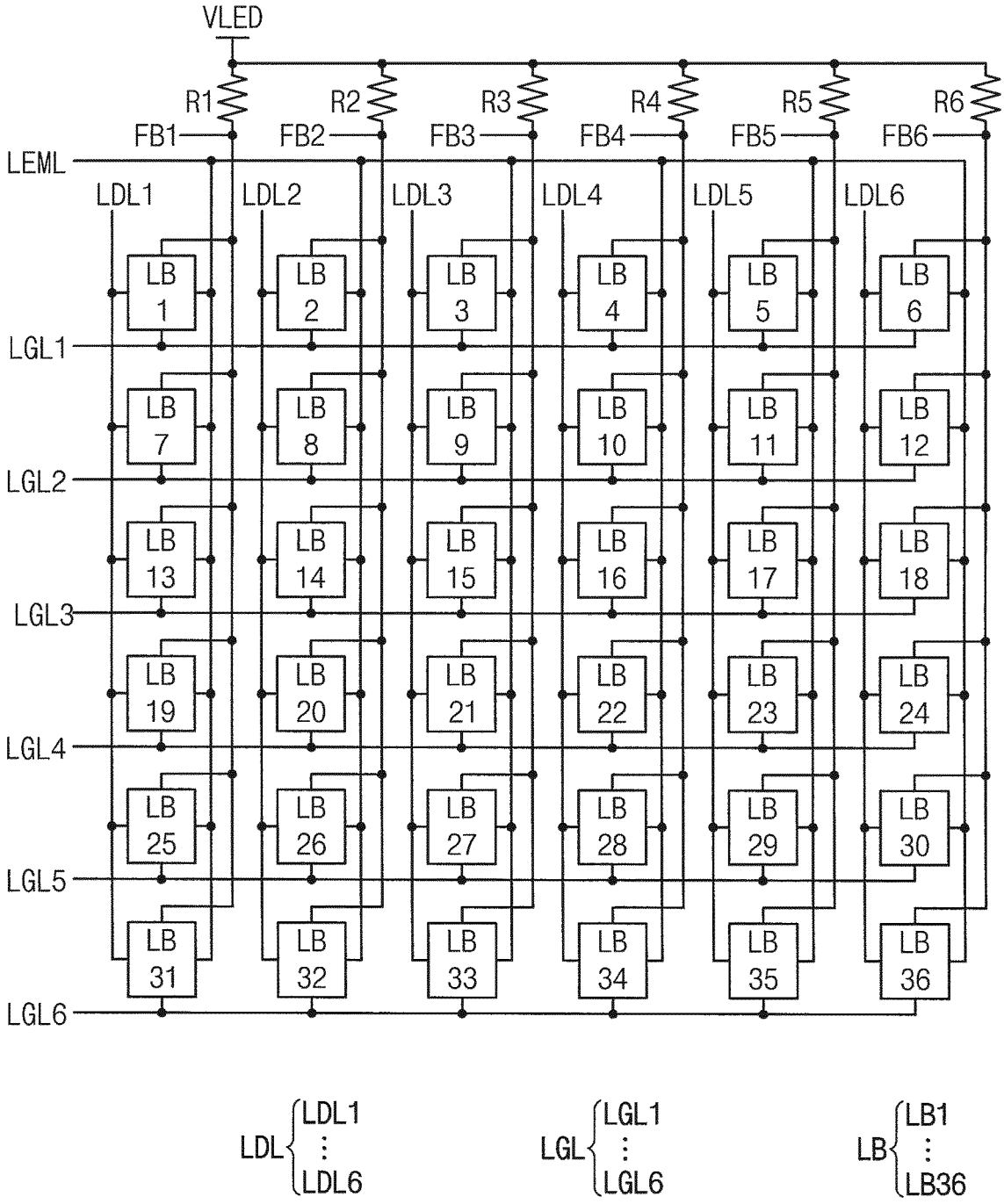
FIG. 2 is a conceptual diagram illustrating a light source apparatus of FIG. 1.
Figure 3:
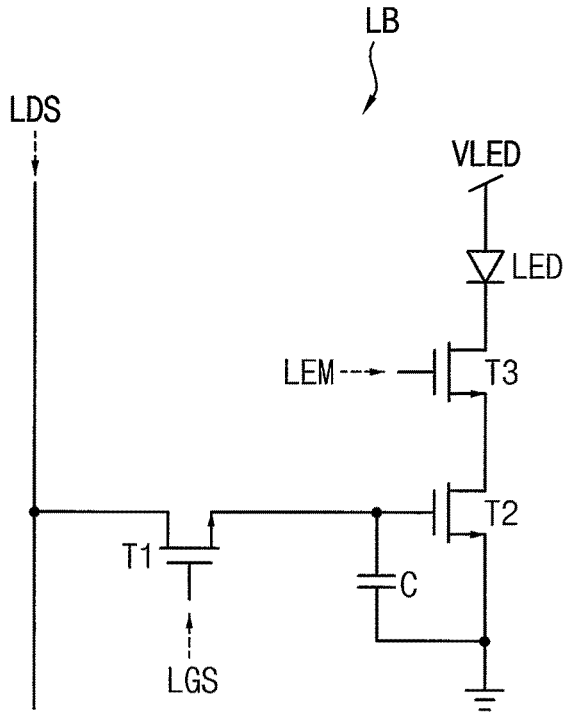
FIG. 3 is a circuit diagram illustrating a light source block of FIG. 2.

FIG. 2 is a conceptual diagram illustrating the light source apparatus BLU of FIG. 1. FIG. 3 is a circuit diagram illustrating a light source block LB of FIG. 2.

Referring to FIGS. 1 to 3, the light source apparatus BLU includes a plurality of light source blocks LB1 to LB36. The light source apparatus BLU further includes a plurality of light source gate lines LGL1 to LGL6 extending in the first direction D1 and a plurality of light source data lines LDL1 to LDL6, a plurality of light source emission lines LEML and a plurality of feedback lines FB1 to FB6 extending in the second direction D2 crossing the first direction D1. The light source emission lines LEML may be commonly connected.

At least one of the light source blocks LB1 to LB36 is connected to the light source gate line, the light source data line, the light source emission line and the feedback line. In an exemplary embodiment, each of the light source blocks LB1 to LB36 may be connected to the light source gate line, the light source data line, the light source emission line and the feedback line, for example. When the light source gate signal is applied to the light source gate line, a switching element in each of the light source blocks LB1 to LB36 is turned on so that the light source data signal is charged to the light source block LB1 to LB36. During the light source emission signal is applied, the light source blocks LB1 to LB36 emit light in a luminance corresponding to the light source data signal. In an exemplary embodiment, the light source data signal is divided into a plurality of bits and emission durations of the bits may be variously set so that the light source blocks LB1 to LB36 may be driven in a digital driving method, for example.

The light source block includes a light emitting element. In an exemplary embodiment, the light source block may include a single light emitting element, for example. In an alternative exemplary embodiment, the light source block may include a plurality of light emitting elements. The light source block may include a light emitting element string including a plurality of light emitting elements connected to each other in series. In an exemplary embodiment, the light emitting element may be a light emitting diode ("LED"), for example.

Although the light source apparatus includes the thirty six light source blocks LB1 to LB36 forming a six by six matrix in the illustrated exemplary embodiment, the invention is not limited thereto. In an alternative exemplary embodiment, the light source apparatus may include light source blocks less than thirty six or more than thirty six.

The feedback line may be commonly connected to the light source blocks disposed in the light source block column. A first feedback line FB1 may be connected to a first light source block LB1, a seventh light source block LB7, a thirteenth light source block LB13, a nineteenth light source block LB19, a twenty fifth light source block LB25 and a thirty first light source block LB31 disposed in a first light source block column. A second feedback line FB2 may be connected to a second light source block LB2, an eighth light source block LB8, a fourteenth light source block LB14, a twentieth light source block LB20, a twenty sixth light source block LB26 and a thirty second light source block LB32 disposed in a second light source block column. A third feedback line FB3 may be connected to a third light source block LB3, a ninth light source block LB9, a fifteenth light source block LB15, a twenty first light source block LB21, a twenty seventh light source block LB27 and a thirty third light source block LB33 disposed in a third light source block column. A fourth feedback line FB4 may be connected to a fourth light source block LB4, a tenth light source block LB10, a sixteenth light source block LB16, a twenty second light source block LB22, a twenty eighth light source block LB28 and a thirty fourth light source block LB34 disposed in a fourth light source block column. A fifth feedback line FB5 may be connected to a fifth light source block LB5, an eleventh light source block LB11, a seventeenth light source block LB17, a twenty third light source block LB23, a twenty ninth light source block LB29 and a thirty fifth light source block LB35 disposed in a fifth light source block column. A sixth feedback line FB6 may be connected to a sixth light source block LB6, a twelfth light source block LB12, an eighteenth light source block LB18, a twenty fourth light source block LB24, a thirtieth light source block LB30 and a thirty sixth light source block LB36 disposed in a sixth light source block column.

A first end portion of the feedback line may be connected to the light source blocks in the light source block column and a second end portion of the feedback line may be connected to a feedback resistor. In an exemplary embodiment, a first end portion of the first feedback line FB1 may be connected to the light source blocks LB1, LB7, LB13, LB19, LB25 and LB31 in the first light source block column and a second end portion of the first feedback line FB1 may be connected to a first feedback resistor R1, for example. In the same way, the second feedback line FB2 may be connected to a second feedback resistor R2, the third feedback line FB3 may be connected to a third feedback resistor R3, the fourth feedback line FB4 may be connected to a fourth feedback resistor R4, the fifth feedback line FB5 may be connected to a fifth feedback resistor R5 and the sixth feedback line FB6 may be connected to a sixth feedback resistor R6.

The feedback resistors R1 to R6 may be connected between a power voltage applying terminal VLED of the light source block and the second end portion of the feedback lines FB1 to FB6.

The light source block LB may include a light emitting element LED, a first switching element T1, a second switching element T2 and a third switching element T3. The first switching element T1 includes a control electrode connected to the light source gate line LGL, an input electrode connected to the light source data line LDL and an output electrode connected to a control electrode of the second switching element T2. The second switching element T2 includes a control electrode connected to the output electrode of the first switching element T1, an input electrode connected to an output electrode of the third switching element T3 and an output electrode connected to a ground. The third switching element T3 includes a control electrode connected to the light source emission line LEML, an input electrode connected to the light emitting element LED and the output electrode connected to the input electrode of the second switching element T2. Although the light emitting element LED is a single light emitting diode in FIG. 3, the light emitting element LED may be a light emitting diode string including a plurality of light emitting diodes. The light source block LB may further include a capacitor C connected between a control terminal of the second switching element T2 and the ground.

In the illustrated exemplary embodiment, the plurality of feedback lines FB1 to FB6 may extend in a direction parallel to the light source data lines LDL1 to LDL6 in an area corresponding to the display area of the display panel 100.

In addition, the plurality of light source emission lines (a plurality of branches of LEML) may extend in a direction parallel to the light source data lines LDL1 to LDL6 in the area corresponding to the display area of the display panel 100.

Figure 4:
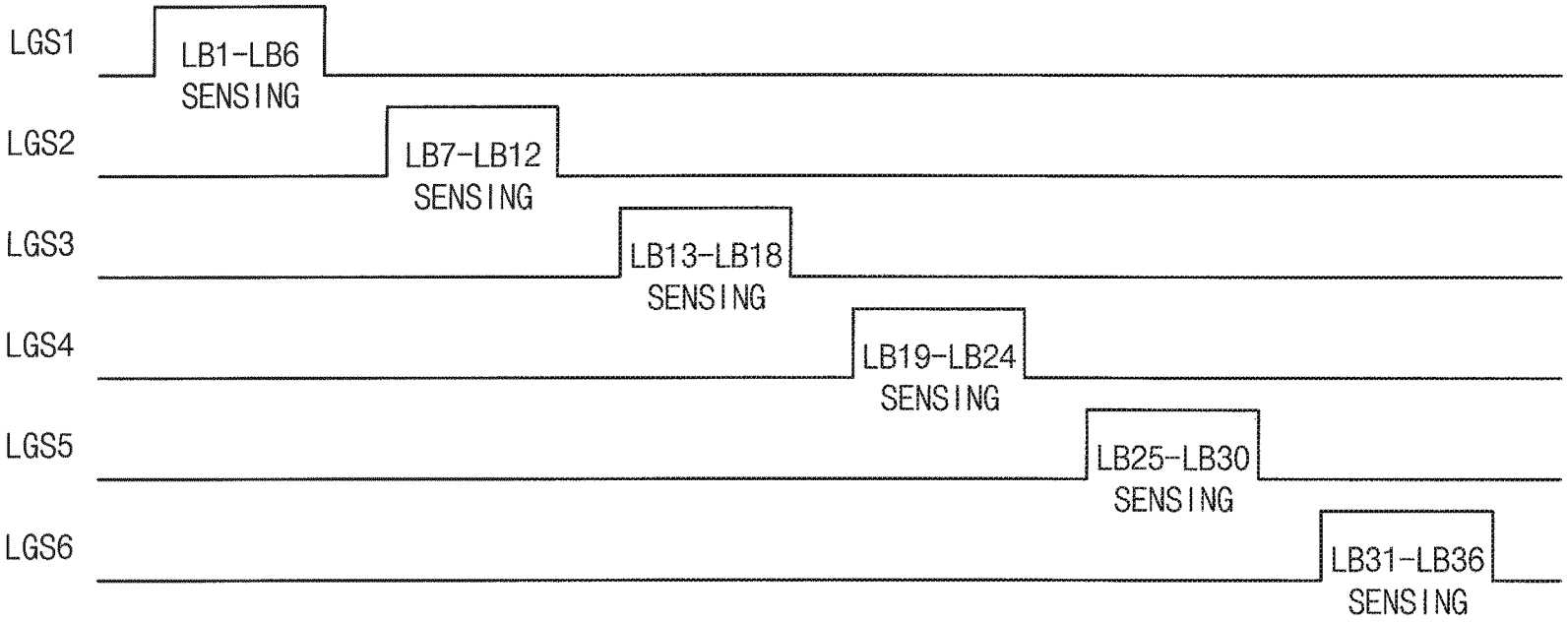
FIG. 4 is a timing diagram illustrating a method of sensing a current of the light source block of FIG. 2.
Figure 5:
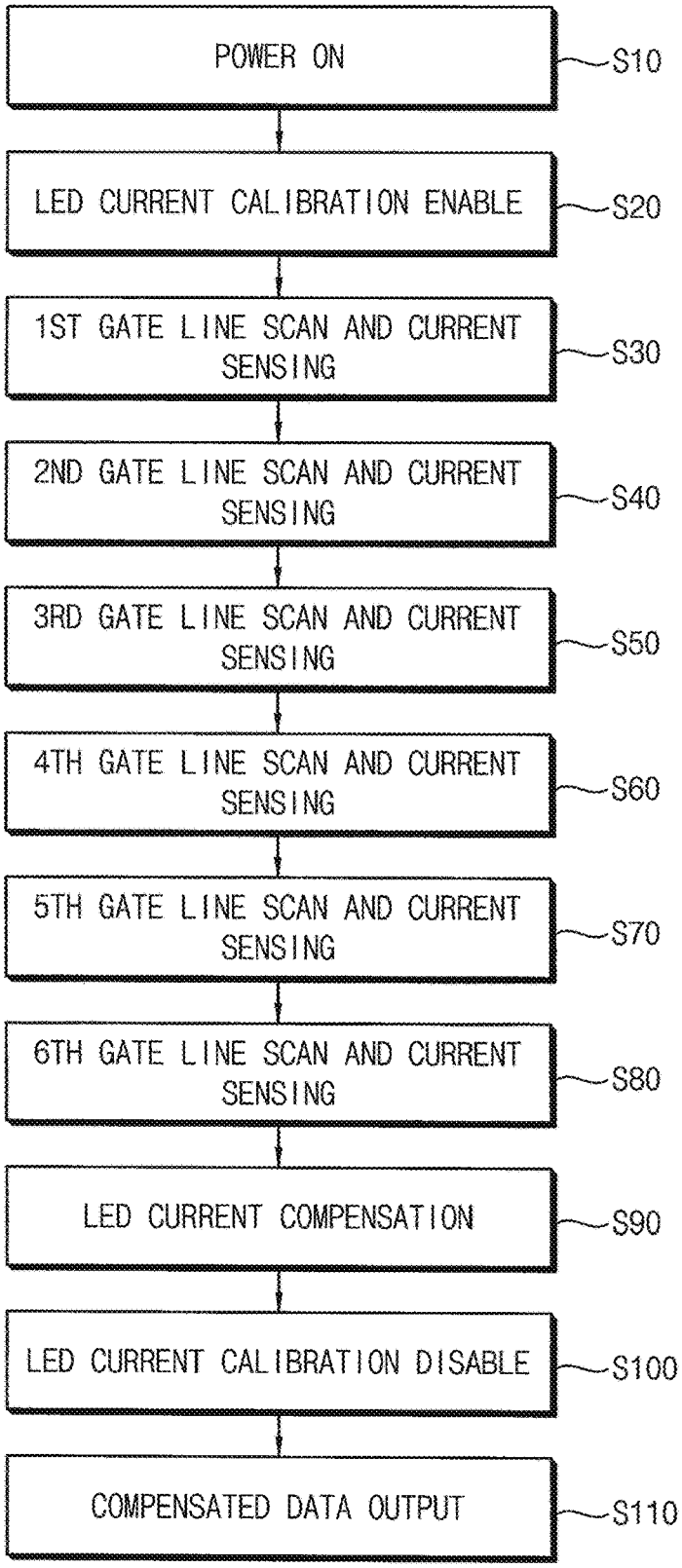
FIG. 5 is a flowchart diagram illustrating a method of compensating luminance difference of the light source apparatus of FIG. 2.
Figure 6:
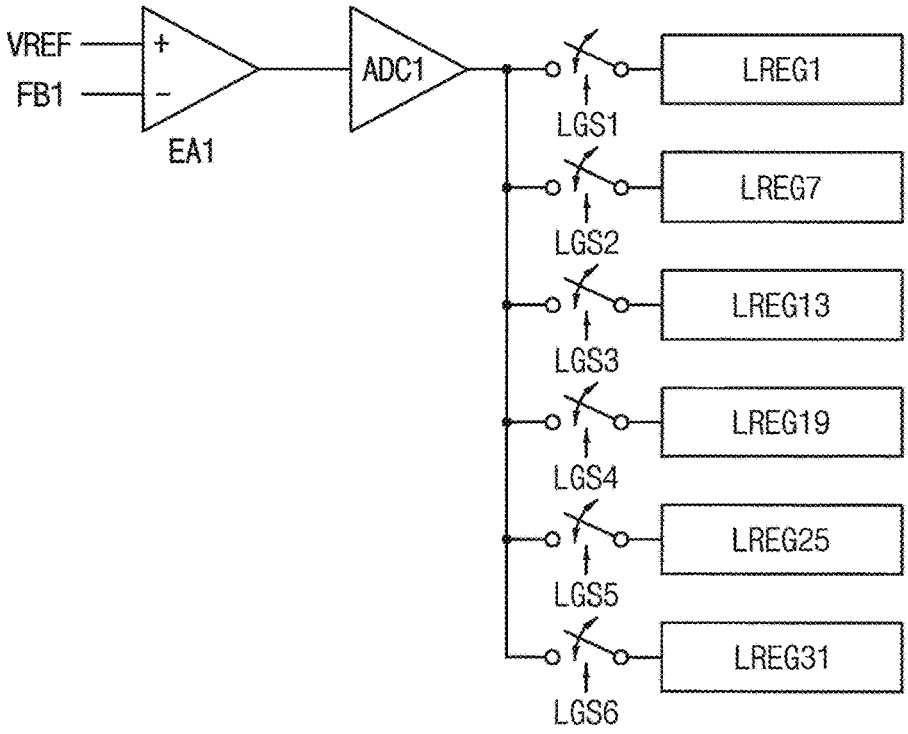
FIG. 6 is a circuit diagram illustrating light source registers storing sensed currents of light source blocks in a first light source block column of FIG. 2.
Figure 7:
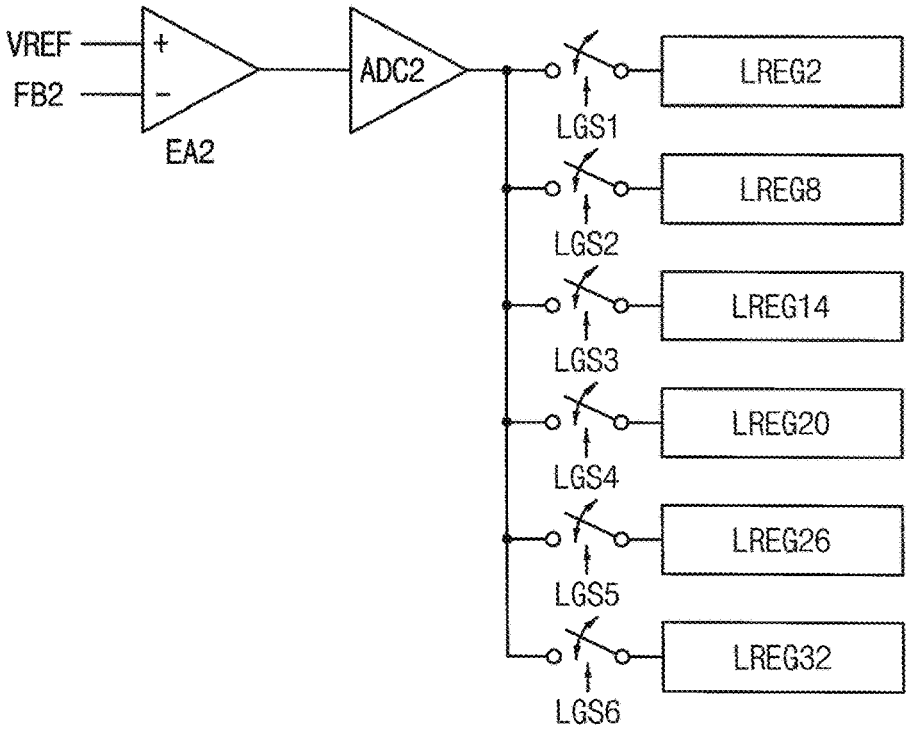
FIG. 7 is a circuit diagram illustrating light source registers storing sensed currents of light source blocks in a second light source block column of FIG. 2.
Figure 8:
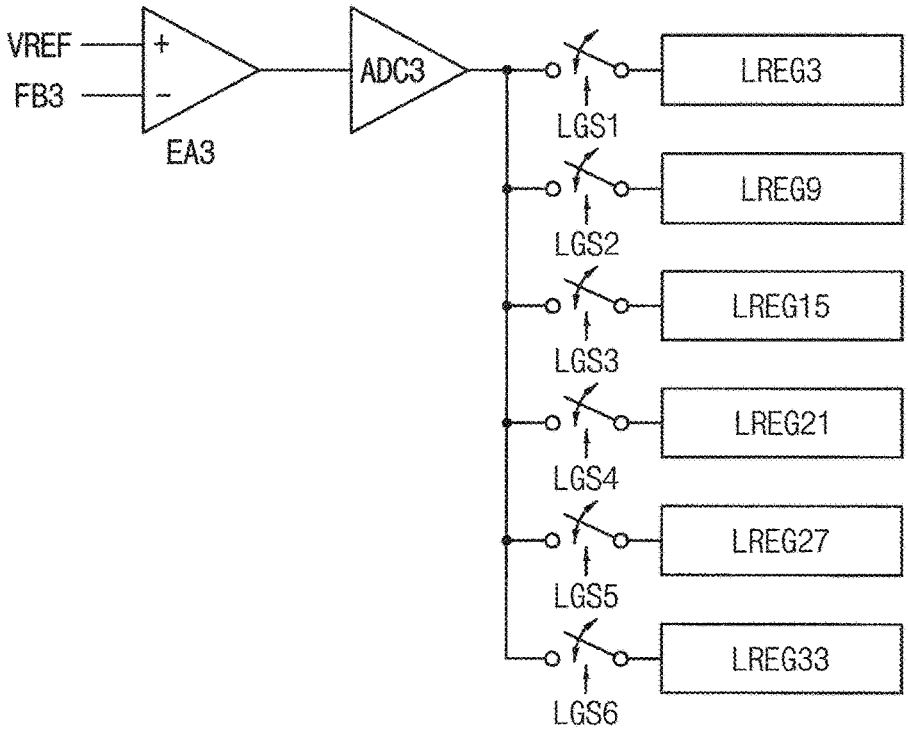
FIG. 8 is a circuit diagram illustrating light source registers storing sensed currents of light source blocks in a third light source block column of FIG. 2.
Figure 9:
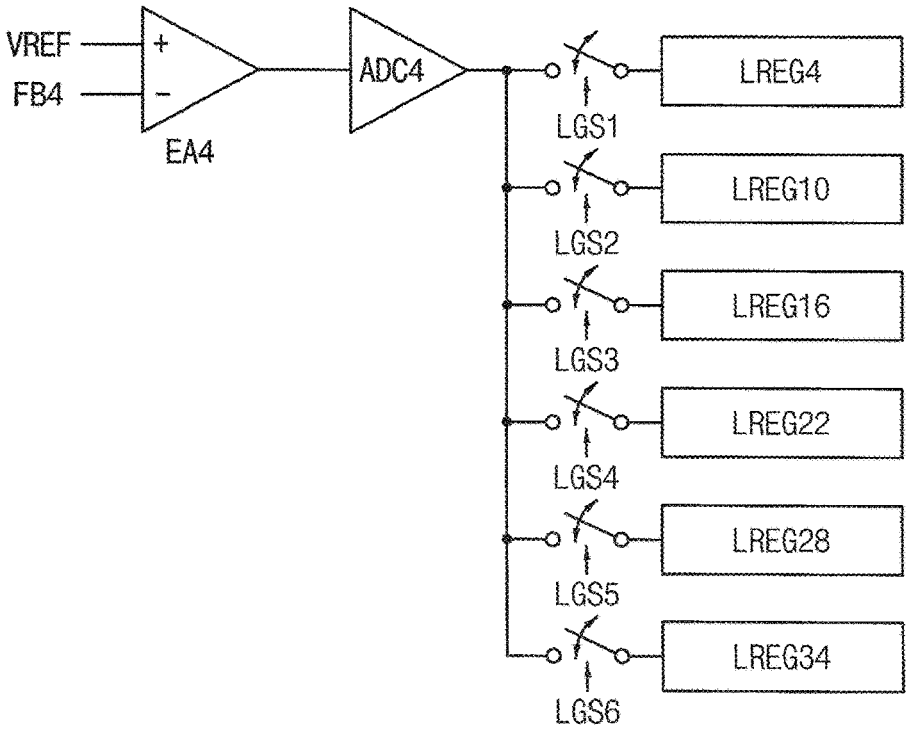
FIG. 9 is a circuit diagram illustrating light source registers storing sensed currents of light source blocks in a fourth light source block column of FIG. 2.
Figure 10:
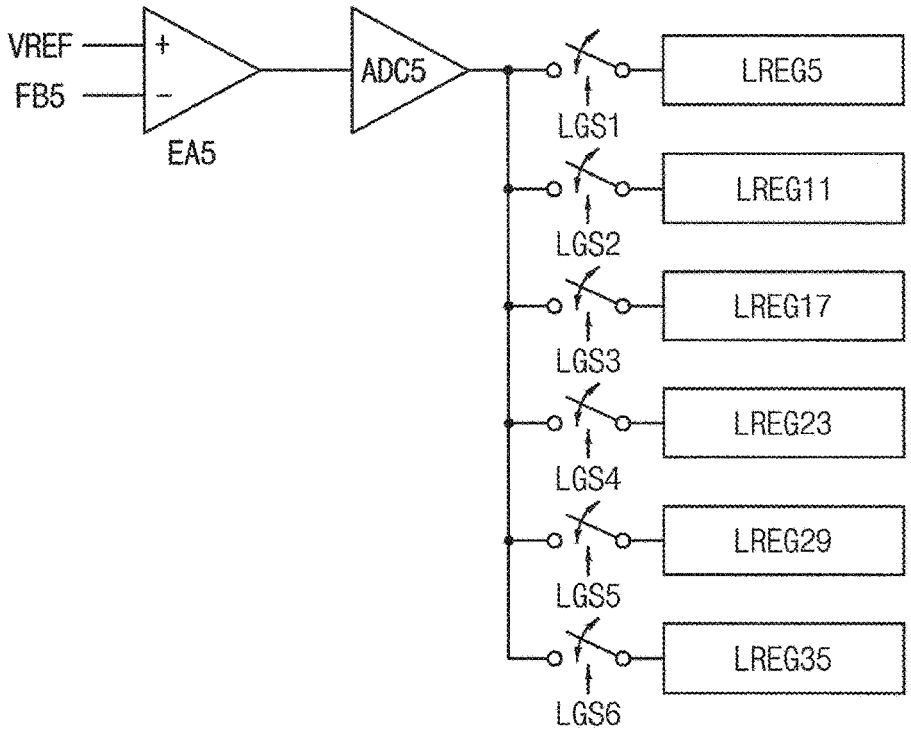
FIG. 10 is a circuit diagram illustrating light source registers storing sensed currents of light source blocks in a fifth light source block column of FIG. 2.
Figure 11:
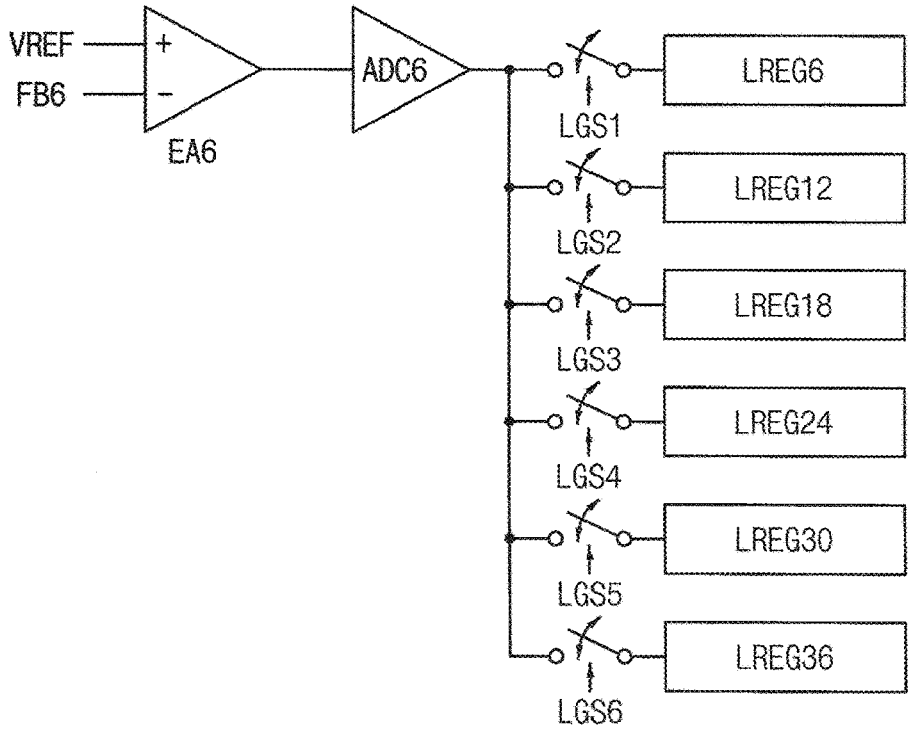
FIG. 11 is a circuit diagram illustrating light source registers storing sensed currents of light source blocks in a sixth light source block column of FIG. 2.
Figure 12:
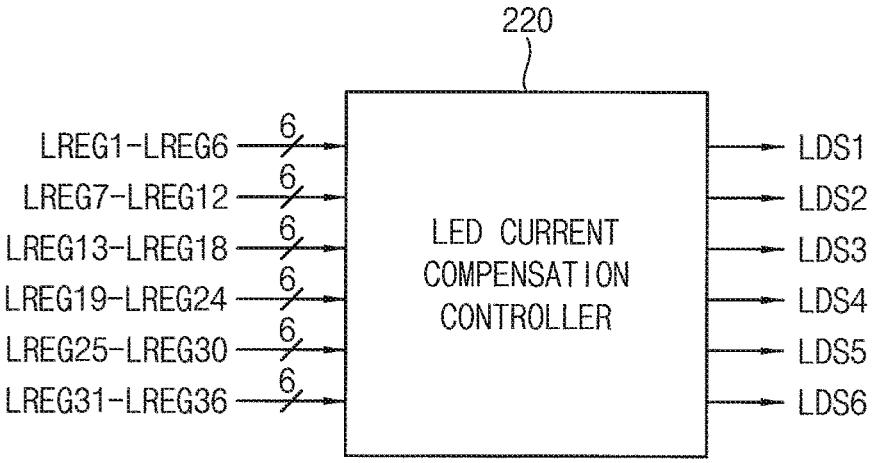
FIG. 12 is a block diagram illustrating a compensation controller compensating luminance difference of the light source apparatus of FIG. 2.

FIG. 4 is a timing diagram illustrating a method of sensing a current of the light source block LB of FIG. 2. FIG. 5 is a flowchart diagram illustrating a method of compensating luminance difference of the light source apparatus BLU of FIG. 2. FIG. 6 is a circuit diagram illustrating light source registers LREG1, LREG7, LREG13, LREG19, LREG25 and LREG31 storing sensed currents of light source blocks LB1, LB7, LB13, LB19, LB25 and LB31 in the first light source block column of FIG. 2. FIG. 7 is a circuit diagram illustrating light source registers LREG2, LREG8, LREG14, LREG20, LREG26 and LREG32 storing sensed currents of light source blocks LB2, LB8, LB14, LB20, LB26 and LB32 in the second light source block column of FIG. 2. FIG. 8 is a circuit diagram illustrating light source registers LREG3, LREG9, LREG15, LREG21, LREG27 and LREG33 storing sensed currents of light source blocks LB3, LB9, LB15, LB21, LB27 and LB33 in the third light source block column of FIG. 2. FIG. 9 is a circuit diagram illustrating light source registers LREG4, LREG10, LREG16, LREG22, LREG28 and LREG34 storing sensed currents of light source blocks LB4, LB10, LB16, LB22, LB28 and LB34 in the fourth light source block column of FIG. 2. FIG. 10 is a circuit diagram illustrating light source registers LREG5, LREG11, LREG17, LREG23, LREG29 and LREG35 storing sensed currents of light source blocks LB5, LB11, LB17, LB23, LB29 and LB35 in the fifth light source block column of FIG. 2. FIG. 11 is a circuit diagram illustrating light source registers LREG6, LREG12, LREG18, LREG24, LREG30 and LREG36 storing sensed currents of light source blocks LB6, LB12, LB18, LB24, LB30 and LB36 in the sixth light source block column of FIG. 2. FIG. 12 is a block diagram illustrating a compensation controller (e.g., LED current compensation controller) 220 compensating luminance difference of the light source apparatus BLU of FIG. 2.

Referring to FIGS. 1 to 12, the display apparatus may include a light source compensator including a plurality of light source registers LREG1 to LREG36 and the compensation controller 220. The light source registers LREG1 to LREG36 stores the sensed currents of the light source blocks LB1 to LB36 which are fed back through the feedback lines FB1 to FB6. In an exemplary embodiment, the number of the light source registers may be same as the number of the light source blocks, for example.

In the illustrated exemplary embodiment, the light source compensator may be disposed in the driving controller 200.

When the light source apparatus BLU includes light source blocks forming two by two matrix, the light source compensator may include a first light source register storing a first sensed current in response to a first light source gate signal through a first feedback line, a second light source register storing a second sensed current in response to the first light source gate signal through a second feedback line, a third light source register storing a third sensed current in response to a second light source gate signal through the first feedback line and a fourth light source register storing a fourth sensed current in response to the second light source gate signal through the second feedback line.

When the light source apparatus BLU includes light source blocks forming a two by two matrix, the light source compensator may further include a first error amplifier and a first analog to digital converter ("ADC"). The first error amplifier may compare the signal transmitted through the first feedback line to a reference voltage. The first ADC may be connected to the first error amplifier. Herein, the first ADC may be connected to the first light source register and the third light source register. In addition, when the light source apparatus BLU includes light source blocks forming the two by two matrix, the light source compensator may further include a second error amplifier and a second ADC. The second error amplifier may compare the signal transmitted through the second feedback line to the reference voltage. The second ADC may be connected to the second error amplifier. Herein, the second ADC may be connected to the second light source register and the fourth light source register.

When the light source apparatus BLU includes light source blocks LB1 to LB36 forming a six by six matrix as shown in FIG. 2, the light source compensator may include thirty six light source registers and six error amplifiers and six ADCs.

To compensate the luminance difference of the light source apparatus BLU, the plurality of light source gate signals LGS1 to LGS6 may be applied to the plurality of light source gate lines LGL1 to LGL6, a plurality of test light source data signals may be applied to the plurality of light source data lines LDL1 to LDL6 and the light source emission signal LEM may be applied to the plurality of light source emission lines LEML. The currents flowing through the light source blocks LB1 to LB36 may be sensed through the feedback lines FB1 to FB6. In an exemplary embodiment, the test light source data signals may correspond to a maximum luminance, for example. In an alternative exemplary embodiment, the test light source data signals may correspond to a predetermined luminance.

The compensated light source data signal is generated using the currents sensed through the feedback lines FB1 to FB6 so that the luminance difference between the light source blocks LB1 to LB36 of the light source apparatus BLU may be compensated.

As shown in FIG. 4, the currents of the first to sixth light source blocks LB1 to LB6 are sensed through the first to sixth feedback lines FB1 to FB6 in a duration when the first light source gate signal LGS1 has an active level. The currents of the seventh to twelfth light source blocks LB7 to LB12 are sensed through the first to sixth feedback lines FB1 to FB6 in a duration when the second light source gate signal LGS2 has an active level. The currents of the thirteenth to eighteenth light source blocks LB13 to LB18 are sensed through the first to sixth feedback lines FB1 to FB6 in a duration when the third light source gate signal LGS3 has an active level. The currents of the nineteenth to twenty fourth light source blocks LB19 to LB24 are sensed through the first to sixth feedback lines FB1 to FB6 in a duration when the fourth light source gate signal LGS4 has an active level. The currents of the twenty fifth to thirtieth light source blocks LB25 to LB30 are sensed through the first to sixth feedback lines FB1 to FB6 in a duration when the fifth light source gate signal LGS5 has an active level. The currents of the thirty first to thirty sixth light source blocks LB31 to LB36 are sensed through the first to sixth feedback lines FB1 to FB6 in a duration when the sixth light source gate signal LGS6 has an active level.

Herein, the method of compensating the luminance difference of the light source apparatus is explained step by step referring to FIG. 5. After the display apparatus is turned on (operation S10), a current calibration operation of the light source apparatus BLU is enabled (operation S20).

As shown in FIG. 4, the currents of the light source blocks disposed in the first to sixth light source block rows are sensed by sequentially activating the first to sixth light source gate signals LGS1 to LGS6 (operation S30 to operation S80).

The sensed currents may be stored in the light source registers LREG1 to LREG36. The compensation controller 220 may generate the compensated light source data signal using the sensed currents which are stored in the light source registers LREG1 to LREG36 (operation S90).

After the compensated light source data signal is generated, the current calibration operation of the light source apparatus BLU is disabled (operation S100).

After the current calibration operation of the light source apparatus BLU is disabled, the compensated light source data signal is outputted to the light source apparatus BLU (operation S110).

As shown in FIG. 6, the light source compensator includes a first error amplifier EA1 and a first ADC ADC1. The first error amplifier EA1 compares a signal transmitted through the first feedback line FB1 to a reference voltage VREF. The first ADC ADC1 is connected to the first error amplifier EA1. The first ADC ADC1 is connected to the first light source register LREG1 and stores the sensed current of the first light source block LB1 to the first light source register LREG1 when the first gate signal LGS1 has an active level. The first ADC ADC1 is connected to the seventh light source register LREG7 and stores the sensed current of the seventh light source block LB7 to the seventh light source register LREG7 when the second gate signal LGS2 has an active level. The first ADC ADC1 is connected to the thirteenth light source register LREG13 and stores the sensed current of the thirteenth light source block LB13 to the thirteenth light source register LREG13 when the third gate signal LGS3 has an active level. The first ADC ADC1 is connected to the nineteenth light source register LREG19 and stores the sensed current of the nineteenth light source block LB19 to the nineteenth light source register LREG19 when the fourth gate signal LGS4 has an active level. The first ADC ADC1 is connected to the twenty fifth light source register LREG25 and stores the sensed current of the twenty fifth light source block LB25 to the twenty fifth light source register LREG25 when the fifth gate signal LGS5 has an active level. The first ADC ADC1 is connected to the thirty first light source register LREG31 and stores the sensed current of the thirty first light source block LB31 to the thirty first light source register LREG31 when the sixth gate signal LGS6 has an active level.

As shown in FIG. 7, the light source compensator includes a second error amplifier EA2 and a second ADC ADC2. The second error amplifier EA2 compares a signal transmitted through the second feedback line FB2 to the reference voltage VREF. The second ADC ADC2 is connected to the second error amplifier EA2. The second ADC ADC2 is connected to the second light source register LREG2 and stores the sensed current of the second light source block LB2 to the second light source register LREG2 when the first gate signal LGS1 has the active level. The second ADC ADC2 is connected to the eighth light source register LREG8 and stores the sensed current of the eighth light source block LB8 to the eighth light source register LREG8 when the second gate signal LGS2 has the active level. The second ADC ADC2 is connected to the fourteenth light source register LREG14 and stores the sensed current of the fourteenth light source block LB14 to the fourteenth light source register LREG14 when the third gate signal LGS3 has the active level. The second ADC ADC2 is connected to the twentieth light source register LREG20 and stores the sensed current of the twentieth light source block LB20 to the twentieth light source register LREG20 when the fourth gate signal LGS4 has the active level. The second ADC ADC2 is connected to the twenty sixth light source register LREG26 and stores the sensed current of the twenty sixth light source block LB26 to the twenty sixth light source register LREG26 when the fifth gate signal LGS5 has the active level. The second ADC ADC2 is connected to the thirty second light source register LREG32 and stores the sensed current of the thirty second light source block LB32 to the thirty second light source register LREG32 when the sixth gate signal LGS6 has the active level.

As shown in FIG. 8, the light source compensator includes a third error amplifier EA3 and a third ADC ADC3. The third error amplifier EA3 compares a signal transmitted through the third feedback line FB3 to the reference voltage VREF. The third ADC ADC3 is connected to the third error amplifier EA3. The third ADC ADC3 is connected to six of the light source registers and stores the corresponding sensed current of light source blocks to the six light source registers as explained referring to FIGS. 6 and 7.

As shown in FIG. 9, the light source compensator includes a fourth error amplifier EA4 and a fourth ADC ADC4. The fourth error amplifier EA4 compares a signal transmitted through the fourth feedback line FB4 to the reference voltage VREF. The fourth ADC ADC4 is connected to the fourth error amplifier EA4. The fourth ADC ADC4 is connected to six of the light source registers and stores the corresponding sensed current of light source blocks to the six light source registers as explained referring to FIGS. 6 and 7.

As shown in FIG. 10, the light source compensator includes a fifth error amplifier EA5 and a fifth ADC ADC5. The fifth error amplifier EA5 compares a signal transmitted through the fifth feedback line FB5 to the reference voltage VREF. The fifth ADC ADC5 is connected to the fifth error amplifier EA5. The fifth ADC ADC5 is connected to six of the light source registers and stores the corresponding sensed current of light source blocks to the six light source registers as explained referring to FIGS. 6 and 7.

As shown in FIG. 11, the light source compensator includes a sixth error amplifier EA6 and a sixth ADC ADC6. The sixth error amplifier EA6 compares a signal transmitted through the sixth feedback line FB6 to the reference voltage VREF. The sixth ADC ADC6 is connected to the sixth error amplifier EA6. The sixth ADC ADC6 is connected to six of the light source registers and stores the corresponding sensed current of light source blocks to the six light source registers as explained referring to FIGS. 6 and 7.

Figure 14:
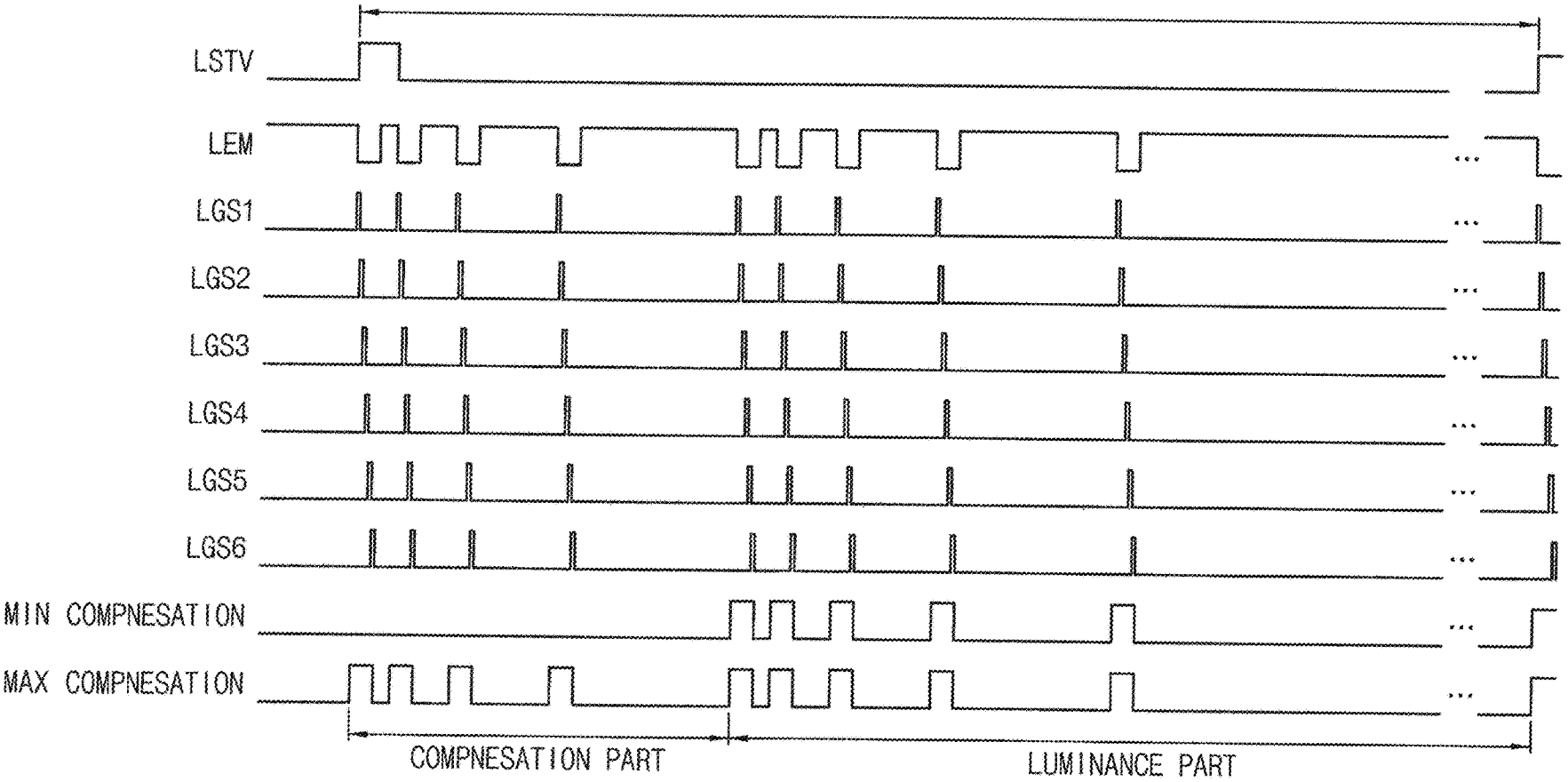
FIG. 14 is a timing diagram illustrating input signals to drive the light source apparatus of FIG. 2.

FIG. 13 is a conceptual diagram illustrating a configuration of a compensated light source data signal generated by the compensation controller 220 of FIG. 12. FIG. 14 is a timing diagram illustrating input signals to drive the light source apparatus BLU of FIG. 2.

Referring to FIGS. 1 to 14, the compensated light source data signal may include luminance data bits representing a target luminance according to a local dimming method and compensation data bit for compensating the luminance difference between the light source blocks LB.

Although the luminance data bits are ten bits and the compensation data bits are four bits in FIG. 13, the invention is not limited to the number of the luminance data bits and the number of the compensation data bits. In an exemplary embodiment, when the luminance difference between the light source blocks LB are relatively great, the number of the compensation bits may be set to be great, for example. In contrast, when the luminance difference between the light source blocks LB are relatively little, the number of the compensation bits may be set to be little.

In an exemplary embodiment, the luminance data bits have a value of "0000000000" for a minimum luminance (e.g. 0 grayscale) and a value of "1111111111" for a maximum luminance (e.g. 1023 grayscale), for example.

In an exemplary embodiment, the compensation data bits have a value of "0000" for a minimum compensation value (e.g. 0 grayscale) and "1111" for a maximum compensation value (e.g. 15 grayscale), for example.

In FIG. 14, a compensation period corresponding to the compensation data bits may be disposed in an early period of the compensated light source data signal and a luminance period corresponding to the luminance data bits may be disposed in a late period of the compensated light source data signal.

When a light source vertical start signal LSTV has an active level (e.g. a high level), a frame starts. During a non-emission duration, the light source emission signal LEM has an inactive level (e.g. a low level). During the non-emission duration, the compensated light source data signal is written to the light source block. During an emission duration, the light source emission signal LEM has an active level (e.g. a high level). During the emission duration, the light source block provides light to the display panel 100 based on the compensated light source data signal which is written to the light source block.

The compensation period corresponds to a length for four bits. Although the luminance period corresponds to a length for ten bits, the luminance period is illustrated corresponding to a length for five bits in FIG. 14 for convenience of explanation.

In an exemplary embodiment, when a light source block represents relatively maximum luminance in the light source apparatus for a target luminance, the light source block may be compensated by the minimum compensation value (e.g. 0000), for example. In contrast, when a light source block represents relatively minimum luminance in the light source apparatus for the target luminance, the light source block may be compensated by the maximum compensation value (e.g. 1111). Thus, the luminance difference between the light source blocks may be compensated by the compensation data bits.

The compensation value may be varied according to the target luminance of the luminance data bits. In an exemplary embodiment, when the target luminance of the luminance data bits is great, the compensation value may be great, for example. In an exemplary embodiment, when the target luminance of the luminance data bits is little, the compensation value may be little, for example.

According to the illustrated exemplary embodiment, the light source apparatus BLU may be driven using the active matrix method so that the manufacturing cost and the complexity of the light source apparatus BLU may be reduced. The light source apparatus BLU includes the light source blocks LB1 to LB36 connected to the light source gate lines LGL1 to LGL6, the light source data lines LDL1 to LDL6, the light source emission lines LEML and the feedback lines FB1 to FB6, and the currents of the light source blocks LB1 to LB36 are fed back so that the luminance difference between the light source blocks LB1 to LB36 may be compensated.

Figure 15:
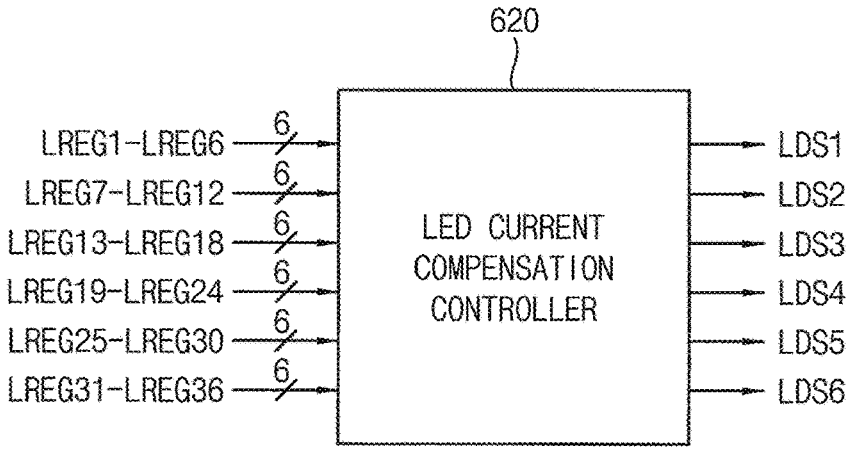
FIG. 15 is a block diagram illustrating an exemplary embodiment of a compensation controller compensating luminance difference of a light source apparatus according to the invention.

FIG. 15 is a block diagram illustrating a compensation controller compensating luminance difference of a light source apparatus according to an exemplary embodiment of the invention.

The light source apparatus and the display apparatus according to the illustrated exemplary embodiment is substantially the same as the light source apparatus and the display apparatus of the previous exemplary embodiment explained referring to FIGS. 1 to 14 except that the compensation controller is disposed in the light source driver. Thus, the same reference numerals will be used to refer to the same or like parts as those described in the previous exemplary embodiment of FIGS. 1 to 14 and any repetitive explanation concerning the above elements will be omitted.

Referring to FIGS. 1 to 11 and 13 to 15, the display apparatus includes a display panel 100 and a display panel driver. The display panel driver includes a driving controller 200, a gate driver 300, a gamma reference voltage generator 400 and a data driver 500. The display apparatus may further include a light source apparatus BLU providing light to the display panel 100 and a light source driver 600 driving the light source apparatus BLU.

The display apparatus may include a light source compensator including a plurality of light source registers LREG1 to LREG36 and a compensation controller (e.g., LED current compensation controller) 620. The light source registers LREG1 to LREG36 stores the sensed currents of the light source blocks LB1 to LB36 which are fed back through the feedback lines FB1 to FB6. In an exemplary embodiment, the number of the light source registers may be same as the number of the light source blocks, for example.

In the illustrated exemplary embodiment, the light source compensator may be disposed in the light source driver 600. In the illustrated exemplary embodiment, the feedback signal FB may be transmitted to the light source driver 600 and may not be transmitted to the driving controller 200.

According to the illustrated exemplary embodiment, the light source apparatus BLU may be driven using the active matrix method so that the manufacturing cost and the complexity of the light source apparatus BLU may be reduced. The light source apparatus BLU includes the light source blocks LB1 to LB36 connected to the light source gate lines LGL1 to LGL6, the light source data lines LDL1 to LDL6, the light source emission lines LEML and the feedback lines FB1 to FB6, and the currents of the light source blocks LB1 to LB36 are fed back so that the luminance difference between the light source blocks LB1 to LB36 may be compensated.

Figure 16:
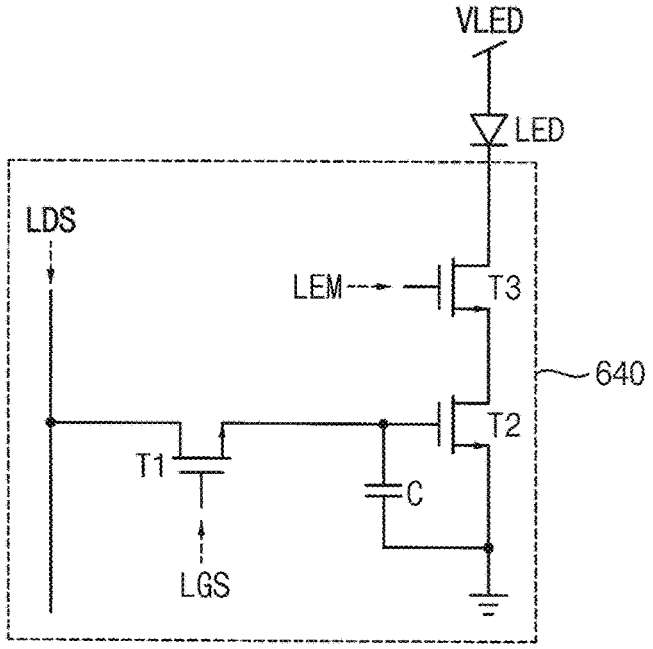
FIG. 16 is a circuit diagram illustrating an exemplary embodiment of a light source driver and a light source block according to the invention.

FIG. 16 is a circuit diagram illustrating a light source driver and a light source block according to an exemplary embodiment of the invention.

The light source apparatus and the display apparatus according to the illustrated exemplary embodiment is substantially the same as the light source apparatus and the display apparatus of the previous exemplary embodiment explained referring to FIGS. 1 to 14 except for the structure of the light source block. Thus, the same reference numerals will be used to refer to the same or like parts as those described in the previous exemplary embodiment of FIGS. 1 to 14 and any repetitive explanation concerning the above elements will be omitted.

Referring to FIGS. 1, 2, 4 to 14 and 16, the display apparatus includes a display panel 100 and a display panel driver. The display panel driver includes a driving controller 200, a gate driver 300, a gamma reference voltage generator 400 and a data driver 500. The display apparatus may further include a light source apparatus BLU providing light to the display panel 100 and a light source driver 600 driving the light source apparatus BLU.

In the illustrated exemplary embodiment, the light source block LB includes a light emitting element LED. The light source circuit 640 of the light source driver 600 may include a first switching element T1, a second switching element T2 and a third switching element T3. The first switching element T1 includes a control electrode connected to the light source gate line LGL (refer to FIG. 2), an input electrode connected to the light source data line LDL and an output electrode connected to a control electrode of the second switching element T2. The second switching element T2 includes a control electrode connected to the output electrode of the first switching element T1, an input electrode connected to an output electrode of the third switching element T3 and an output electrode connected to a ground. The third switching element T3 includes a control electrode connected to the light source emission line LEML, an input electrode connected to the light emitting element LED and the output electrode connected to the input electrode of the second switching element T2. The light source circuit 640 may further include a capacitor C connected between a control terminal of the second switching element T2 and the ground.

According to the illustrated exemplary embodiment, the light source apparatus BLU may be driven using the active matrix method so that the manufacturing cost and the complexity of the light source apparatus BLU may be reduced. The light source apparatus BLU includes the light source blocks LB1 to LB36 connected to the light source gate lines LGL1 to LGL6, the light source data lines LDL1 to LDL6, the light source emission lines LEML and the feedback lines FB1 to FB6 and the currents of the light source blocks LB1 to LB36 are fed back so that the luminance difference between the light source blocks LB1 to LB36 may be compensated.

According to the invention as explained above, the manufacturing cost and the complexity of the light source apparatus BLU may be reduced and the luminance difference between the light source blocks may be effectively compensated using the active matrix method.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A light source apparatus comprising:

a plurality of light source gate lines extending in a first direction;

a plurality of light source data lines extending in a second direction crossing the first direction;

a plurality of light source emission lines;

a plurality of feedback lines; and a plurality of light source blocks, wherein at least one of the plurality of light source blocks is connected to a light source gate line of the plurality of light source gate lines, a light source data line of the plurality of light source data lines, a light source emission line of the plurality of light source emission lines and a feedback line of the plurality of feedback lines, and at least one of the plurality of light source emission lines is commonly connected to at least three light source blocks of the plurality of light source blocks in the second direction.

2. The light source apparatus of claim 1, wherein the feedback line is commonly connected to light source blocks of the plurality of light source blocks disposed in a light source block column.

3. The light source apparatus of claim 2, wherein a first end portion of the feedback line is connected to the light source blocks disposed in the light source block column and a second end portion of the feedback line is connected to a feedback resistor, and wherein the feedback resistor is connected between a power voltage applying terminal of a light source block of the light source blocks and the second end portion of the feedback line.

4. The light source apparatus of claim 1, wherein a light source block of the plurality of light source blocks comprises:

a light emitting element;

a first switching element comprising a control electrode connected to the light source gate line, an input electrode connected to the light source data line and an output electrode connected to a control electrode of a second switching element;

the second switching element comprising the control electrode connected to the output electrode of the first switching element, an input electrode connected to an output electrode of a third switching element and an output electrode connected to a ground; and the third switching element comprising a control electrode connected to the light source emission line, an input electrode connected to the light emitting element and the output electrode connected to the input electrode of the second switching element.

5. The light source apparatus of claim 1, wherein the feedback line extends in a direction parallel to the light source data line.

6. A display apparatus comprising:

a display panel which displays an image;

a gate driver which applies a gate signal to the display panel;

a data driver which applies a data voltage to the display panel;

a light source apparatus which provides light to the display panel; and a light source driver which drives the light source apparatus, wherein the light source apparatus comprises:

a plurality of light source gate lines extending in a first direction;

a plurality of light source data lines extending in a second direction crossing the first direction;

a plurality of light source emission lines;

a plurality of feedback lines; and a plurality of light source blocks, wherein at least one of the plurality of light source blocks is connected to a light source gate line of the plurality of light source gate lines, a light source data line of the plurality of light source data lines, a light source emission line of the plurality of light source emission lines and a feedback line of the plurality of feedback lines, and at least one of the plurality of light source emission lines is commonly connected to at least three light source blocks of the plurality of light source blocks in the second direction.

7. The display apparatus of claim 6, wherein the feedback line is commonly connected to light source blocks of the plurality of light source blocks disposed in a light source block column.

8. The display apparatus of claim 7, wherein a first end portion of the feedback line is connected to the light source blocks disposed in the light source block column and a second end portion of the feedback line is connected to a feedback resistor, and wherein the feedback resistor is connected between a power voltage applying terminal of the light source block and the second end portion of the feedback line.

9. The display apparatus of claim 6, wherein a light source block of the plurality of light source blocks comprises:

a light emitting element;

a first switching element comprising a control electrode connected to the light source gate line, an input electrode connected to the light source data line and an output electrode connected to a control electrode of a second switching element;

the second switching element comprising the control electrode connected to the output electrode of the first switching element, an input electrode connected to an output electrode of a third switching element and an output electrode connected to a ground; and the third switching element comprising a control electrode connected to the light source emission line, an input electrode connected to the light emitting element and the output electrode connected to the input electrode of the second switching element.

10. The display apparatus of claim 6, wherein the light source block comprises a light emitting element, and wherein the light source driver comprises:

a first switching element comprising a control electrode connected to the light source gate line, an input electrode connected to the light source data line and an output electrode connected to a control electrode of a second switching element;

the second switching element comprising the control electrode connected to the output electrode of the first switching element, an input electrode connected to an output electrode of a third switching element and an output electrode connected to a ground; and the third switching element comprising a control electrode connected to the light source emission line, an input electrode connected to the light emitting element and the output electrode connected to the input electrode of the second switching element.

11. The display apparatus of claim 6, wherein the feedback line extends in a direction parallel to the light source data line.

12. The display apparatus of claim 6, further comprising:

a plurality of light source registers which stores sensed currents of light source blocks of the plurality of light source blocks which are fed back through the feedback line; and a light source compensator comprising a compensation controller which receives the sensed currents of the light source blocks which are stored in the plurality of light source registers and generates a compensated light source data signal for compensating luminance difference between the light source blocks.

13. The display apparatus of claim 12, wherein the light source compensator comprises:

a first light source register which stores a first sensed current in response to a first light source gate signal through a first feedback line;

a second light source register which stores a second sensed current in response to the first light source gate signal through a second feedback line;

a third light source register which stores a third sensed current in response to a second light source gate signal through the first feedback line; and a fourth light source register which stores a fourth sensed current in response to the second light source gate signal through the second feedback line.

14. The display apparatus of claim 13, wherein the light source compensator further comprises:

a first error amplifier which compares a signal transmitted through the first feedback line to a reference voltage; and a first analog to digital converter connected to the first error amplifier, and wherein the first analog to digital converter is connected to the first light source register and the third light source register.

15. The display apparatus of claim 14, wherein the light source compensator further comprises:

a second error amplifier which compares a signal transmitted through the second feedback line to the reference voltage; and a second analog to digital converter connected to the second error amplifier, and wherein the second analog to digital converter is connected to the second light source register and the fourth light source register.

16. The display apparatus of claim 12, further comprising a driving controller which controls driving timings of the gate driver, the data driver and the light source driver, wherein the light source compensator is disposed in the driving controller.

17. The display apparatus of claim 12, wherein the light source compensator is disposed in the light source driver.

18. The display apparatus of claim 12, wherein the compensated light source data signal comprises luminance data bits representing a target luminance according to a local dimming method and compensation data bit for compensating the luminance difference between the light source blocks.

19. A method of compensating luminance difference of a light source apparatus, the method comprising:

applying a plurality of light source gate signals to a plurality of light source gate lines extending in a first direction;

applying a plurality of light source data signals to a plurality of light source data lines extending in a second direction crossing the first direction;

applying a light source emission signal to a plurality of light source emission lines;

sensing currents flowing through a plurality of light source blocks through a plurality of feedback lines; and generating a compensated light source data signal using the sensed currents through the plurality of feedback lines, wherein the light source emission signal is commonly applied to at least three light source blocks of the plurality of light source blocks in the second direction.

20. The method of claim 19, wherein the currents flowing through the plurality of light source blocks is sensed in an initial period when a display apparatus is turned on.

* * * * *